US005183494A

United States Patent [19]

Liu et al.

[11] Patent Number: 5,183,494

[45] Date of Patent: Feb. 2, 1993

[54] PROCESS FOR MANUFACTURING RARE EARTH-IRON-BORON PERMANENT MAGNET ALLOY POWDERS

[75] Inventors: Ti Y. Liu, Hsinchu; Chi J. Chen, Kaohsiung; Shou H. Chen, Hsin Chu, all of Taiwan

[73] Assignee: Industrial Technology Research Instiute, Hsinchu, Taiwan

[21] Appl. No.: 690,056

[22] Filed: Apr. 23, 1991

[51] Int. Cl.[5] ..... H01F 1/02

[52] U.S. Cl. ..... 75/349; 148/101

[58] Field of Search ..... 148/101, 302; 420/83, 420/121; 75/349

[56] References Cited

U.S. PATENT DOCUMENTS

| | | | |
|---|---|---|---|
| 4,770,702 | 9/1988 | Ishigaki et al. | 75/244 |
| 4,806,155 | 2/1989 | Camp et al. | 75/349 |
| 4,917,724 | 4/1990 | Sharma | 75/350 |
| 4,990,307 | 2/1991 | Camp | 419/30 |

OTHER PUBLICATIONS

Japanese Patent 63-310906 with English Language Abstract Dec. 11, 1988.

English Language Abstract of Communist China Patent 8600 769 Sep. 1987.

English Language Abstract of Japanese Patent 63 219548 Sep. 1988.

*Primary Examiner*—John P. Sheehan

*Attorney, Agent, or Firm*—Scully, Scott Murphy & Presser

[57] ABSTRACT

A process for producing rare earth-iron-boron permanent magnet alloy powders comprising; heating pellets comprising a mixture of rare earth oxides, iron power, ferroboron powder and calcium grandules for reaction/diffusion to obtain a rare earth-iron-boron alloy of uniform composition, crushing the resulting alloy to form a powder and contacting the powder with an aqueous solution of acetic acid containing a non-ionic surfactant and an alkai metal acetate.

6 Claims, No Drawings

PROCESS FOR MANUFACTURING RARE EARTH-IRON-BORON PERMANENT MAGNET ALLOY POWDERS

BACKGROUND OF THE INVENTION

The present invention relates to a process for manufacturing rare earth-iron-boron permanent magnet alloy powders by the reduction/diffusion (R/D) method.

Alloys with rare earth metals as principal components are used as permanent magnet material, magnetostrictive material, optomagnetic recording material, hydrogen occlusion material and magnetic sensor.

Magnets made of these alloys, e.g. R-Fe-B permanent magnets, have good magnetic properties. Two processes are now in use for the manufacture of alloy powders for R-Fe-B permanent magnets, namely, the powder preparation method of powder metallurgy (P/M) processing and the reduction/diffusion method. In the powder metallurgy method, ingots of rare earth metals and alloying elements are melted using a high frequency melting furnace to form an alloy ingot which is subsequently crushed into powder. However, it is disadvantageons to make powders by crushing because the rare earth metals are easily oxidized during crushing and hence the quality of the alloy is adversely affected.

To eliminate this disadvantage, the reduction/diffusion method was developed. According to this method, a rare earth (R) metal alloy powder is prepared in the following manner. Starting materials consisting of a rare earth metal oxide, iron or cobalt powders and ferroboron powders are mixed with calcium as reducing agent. The mixture obtained is dry pressed and heated in an inert gas atmosphere or vacuum, so that the rare earth metal oxide is brought into contact with melted or vaporous calcium, for reduction. At the same time, the rare earth metal formed by reduction diffuses into the particles of ferroboron, iron or cobalt. Thus, a R-Fe-B alloy powder of uniform composition is obtained. The reaction product obtained is a mixture of CaO formed as a by-product, unreacted excess metallic calcium, and the desired R-Fe-B alloy powder. These components exist in the form of a sintered mass. When the mass is crushed and treated with water, CaO and metallic Ca react with water to form $Ca(OH)_2$, and the alloy powders can easily be separated from $Ca(OH)_2$. When immersed in water, the mass disintegrates in a short time, forming a slurry with $Ca(OH)_2$ being in the upper layer of the suspension which is subsequently removed. Residual $Ca(OH)_2$ is removed by washing the alloy with acetic acid. R-Fe-B alloy powders are thus obtained. Rare earth metal oxides are less costly than rare earth metals. Therefore, this method of manufacturing R-Fe-B alloy powders from RE oxides is more economical than the powder preparation method and is generally preferred.

The two key techniques for the reduction/diffusion method are the prevention of oxidation of the R-Fe-B alloy powders, and the complete removal of residual calcium. The process steps that embrace these two techniques are the steps of disintegration, deionized water washing and acid washing described hereinbefore.

The prior art relating to the manufacture of R-Fe-B alloy powders predominately relate to the reduction/-diffusion process, and rarely the wet process. Most of the literature on the wet process relates to acetic acid washing, which can result in the oxidation of R-Fe-B alloy powders leading to the loss of significant amounts of rare earth metal and, consequently, diminution of the magnetic properties of the resulting alloy.

To overcome the drawbacks described above, Japanese patent 63-310906 discloses the addition of EDTA (ethylene diaminetetraacetic acid) as complexing agent and corrosion inhibitor. However, the effectiveness of acids such as EDTA in the removal of CaO is pH dependent. If the pH value deviates, the effectiveness will be materially affected and the R-Fe-B alloy powders can be oxidized. Besides, the linseed oil (linoleic oil), added to prevent the alloy powders from being oxidized during the wet process, will coagulate the powders and hamper the removal of CaO. In addition, NaOH and $HNO_3$, as disclosed by the patent, are added during the wet process to break up the coagulation of the powders caused by the linseed oil and thus facilitate the separation. However, the use of NaOH, a strong base, and $HNO_3$, a strong acid, will make pH control difficult and the heat of neutralization generated will facilitate oxidation of the rare earth metal. Thus, permanent magnets made from the alloy powders having reduced magnetic properties will be produced in accordance with the Japanese patent method.

DETAILED DESCRIPTION OF THE INVENTION

The present invention provides a process for manufacturing R-Fe-B permanent magnet alloy powders by the reduction/diffusion method whereby the wet process will permit the alloy to disintegrate into individual particles in the aqueous solution and improve the effectiveness of the removal of Ca and CaO while preventing the particles from being oxidized during acetic acid washing. Further, the present invention provides a process for manufacturing R-Fe-B permanent magnet alloy powders by the reduction/diffusion method whereby, by avoiding the acid-base neutralization step, the generation of heat is avoided and thus the potential oxidation of rare earth metal in the alloy product is reduced if not obviated.

The present invention provides an improved process for production of rare earth metal-iron-boron alloys of improved magnetic properties. The improvement which results in the improved alloy product involves the addition of a non-ionic surfactant and an alkali metal acetate to the so-called wet processing step heretofore described, i.e. the water-washing step to remove calcium and calcium oxide from the powdered alloy. The addition of acetic acid to the water washing step can occur before or after the alkali metal acetate and non-ionic surfactant is added but it is preferred that these reagents be present in the aqueous system prior to acetic acid addition for best results. The sequence of addition of non-ionic surfactant and alkali metal acetate is not critical since these may be added separately in any order or even together, neat, or dissolved in water to facilitate mixing.

The process of the present invention is described as follows. A mixture of the starting materials is first prepared which consist of rare earth metallic oxides (Rare earth metals include neodymium (Nd), dysprosium (Dy), praseodymium (Pr), lanthanum (La), cerium (Ce), promethium (Pm), samarium (Sm), europium (Eu), gadolinium (Gd), terbium (Tb), holmium (Ho), erbium (Er), thulium (Tm), ytterbium (Yb) and lutetium (Lu), Fe powder, Ferrous-Boron powder and Ca granules. The amount of each component of the mixture depends on the target composition of the alloy powders. The mixture is charged into a mixer, well mixed in about 30 minutes, and dry pressed into pellets. The pellets are placed into a stainless steel container which is subsequently loaded into a tubular furnace. The furnace is heated to temperatures of from 800°-1300° C. wherein the pellets undergo reduction/diffusion processing under argon atmosphere. The time for this processing is related to the temperature used, the higher the processing temperature, the shorter the processing time and vice versa. The deciding factor is complete reduction and thorough diffusion for an alloy with homogeneous composition. When this reaction is completed, the furnace is cooled to room temperature. The pellets are removed from the furnace and crushed to 10-60 mesh powders (according to Tyler standard screen scale-sieve). The powders are then placed into an aqueous solution of $10^{-3}$-1 vol % polyoxypropylene polyoxyethene ether, a nonionic surfactant having the formula:

$$HO(CH_2CH_2-O)_a(\underset{\underset{CH_3}{|}}{CH}CH_2-O)_b(CH_2CH_2O)_cH,$$

wherein a, b and c are each=1-28, and stirred. The CaO and Ca will react with water to form $Ca(OH)_2$ and $H_2$. In about 30 minutes, the alloy powders will disintegrate into a slurry and $H_2$ will evolve. The nonionic surfactant will be adsorbed to the surfaces of the powders to make the powders individually dispersed in the solution, facilitating the removal of Ca. The adsorbed surfactant will also prevent the powders from being oxidized. An alkali metal (sodium or potassium) acetate ($10^{-3}$-$10^2$ g/l) is then added to the solution which is stirred. The alkali metal acetate serves as a buffer agent to inhibit generation of the neutralization heat which could be generated on addition of the acetic acid used to neutralize calcium hydroxide. Acetic acid is then added dropwise while the solution is stirred to dissolve the $Ca(OH)_2$. When the solution is allowed to stand, the powders will separate out and are recovered from the solution by standard methods, for example, by filtration, followed by washing with deionized water several times and then washing with very dilute acetic acid several times, followed by washing with deionized water several times. The residual water in the powder is removed with acetone, and the powder is then dried.

An alloy powder for rare earth-iron-boron permanent magnet with a composition $R_{34}$-$Fe_{64.7}$-$B_{1.3}$ (R: rare earth metal) is produced.

The powder thus obtained is ball milled to particles with average diameters of 2-6 μm (by Fisher subsieve sizer), and subsequently compacted by a pressure of 2 ton/cm² paralleling to the compacting direction in a magnetic field of 15KOe. The compact is then sintered at a temperature of from 1,000°-1,200° C. in argon atmosphere followed by heat treatment at 500°-800° C. A permanent magnet is thus made, with magnetic properties analyzed by a BH tracer and compositions analyzed by ICP-AES, AAS, N/O analyzer and C/S analyzer.

The excellent magnetic properties and compositions of the magnetic powders manufactured according to the present invention will be fully understood by the following example and comparative examples. The alloy powders in the example and comparative examples 1 and 2 are manufactured in accordance with the present invention and that in comparative example 3 is in accordance with prior art wet processing. The starting materials of the example and the three comparative examples are each of the following composition:

| | |
|---|---|
| $Nd_2O_3$ (powder diameter 0.1-10 μm) | 79.3 g |
| Fe powder (diameter 1-500 μm) | 121.3 g |
| BFe powder (19.6 wt % B—Fe, 1-500 μm) | 13.3 g |
| Ca granules | 36.8 g |

The alloy powders in the example and the comparative examples are all manufactured in accordance with the process described above, namely mixing of the starting materials, reduction/diffusion, crushing, disintegration, washing, drying, compacting, sintering, heat treatment, measurement of magnetic properties and analysis of composition. The magnetic properties and the compositions thus obtained are shown in the table. The only differences among the examples are the additions in the aqueous solution in the wet process as set forth below:

COMPARATIVE EXAMPLE ONE $10^{-3}$--$10^2$ g/l alkaline metal acetate was added as buffer agent.

COMPARATIVE EXAMPLE 2

$10^{-3}$-1 g/l vol% nonionic surfactant was added.

EXAMPLE 1

$10^{-3}$--$10^2$ g/l alkali metal acetate and
$10^{-3}$-1 vol % nonionic surfactant were added.

COMPARATIVE EXAMPLE 3

Nothing was added.

| | | Wet process used | | | |
|---|---|---|---|---|---|
| | | This invention | | | Prior art |
| | | Comp. Example 1 | Comp. EX 2 | Example 1 | Comp EX 3 |
| (wt %) Composition | Nd | 33.5 | 33.4 | 33.8 | 33.2 |
| | B | 1.3 | 1.3 | 1.3 | 1.3 |
| | Ca | 0.11 | 0.05 | 0.05 | 0.21 |
| | O | 0.49 | 0.38 | 0.35 | 0.58 |
| | C | 0.01 | 0.05 | 0.05 | 0.01 |
| | Fe | Bal | Bal | Bal | Bal |
| Magnetic Properties | Br (KG) | 10.5 | 10.9 | 11.2 | 9.8 |
| | iHC (KOe) | 10.2 | 10.4 | 10.3 | 9.7 |
| | (BH)max NGOe | 26.8 | 28.9 | 30.2 | 22.3 |

The alkali metal acetate is used as a buffer agent in the present invention to inhibit the generation of neutralization heat to prevent Nd-Fe-B alloy powder being oxidized so that Nd content in the alloy powder will not be decreased and the oxygen content will not be increased. As can be seen form the table, compared with that obtained by prior art wet process, all of the magnetic powders manufactured by this invention have higher Nd contents, lower $O_2$ contents and better magnetic properties. Apparently, it is very beneficial to add alkali metal acetate during the wet process.

Nonionic surfactant can be adsorbed on the surfaces of the magnetic powders to make them individually dispersed in the water, facilitating the removal of Ca. Again, it can be seen from the table, compared with that obtained by prior art wet process, all of the magnetic powders manufactured by this invention have lower Ca content and better magnetic properties.

As borne out by example 1, the addition of alkaline metal acetate and nonionic surfactant produces the best results in terms of the lowering of Ca and $O_2$ contents and the improving of the magnetic properties, compared with other comparative examples 1 to 3.

What is claimed is:

1. A process for producing rare earth-iron-boron permanent magnetic alloy powders comprising the steps of:

a) heating pellets comprising a mixture of rare earth metal oxides, iron powder, ferroboron powder and calcium granules to a temperature of from about 800 to about 1300° C. for reaction/diffusion under an inert atmosphere to obtain a rare earth-iron-boron alloy of uniform composition, b) powdering the resulting alloy to powders of from about 10 to about 60 mesh;

c) contacting said powders with an agitated aqueous solution of acetic acid containing a non-ionic surfactant and an alkali metal acetate.

2. The process according to claim 1, wherein the rare earth metals in the rare earth metal oxide is selected form the group consisting of neodymium (Nd), dysprosium (Dy), praseodymium (Pr), lanthanum (La), cerium (Ce), promethium (Pm), samarium (Sm), europium (Eu), gadolinium (Gd), terbium (Tb), holmium, erbium (Er), thulium (Tm), ytterbium (Yb) and lutetium (Lu) oxides.

3. The process according to claim 1 wherein the nonionic surfactant is a polyoxypropylene polyoxyethene ether of the formula:

$$HO(CH_2CH_2\text{---}O)_a(\underset{\underset{CH_3}{|}}{C}HCH_2O)_b(CH_2CH_2O)_cH$$

wherein a, b and c are each an integer from 1–28.

4. The process according to claim 1, wherein the amount of he nonionic surfactant added is 0.001–1 vol. % of the aqueous solution.

5. The process according to claim 1, wherein the alkali metal acetate added is selected form the group consisting of sodium acetate and potassium acetate.

6. The process according to claim 1, wherein the amount of the alkali metal acetate is $10^{-3}$–$[10^{-2}]$ $10^{2}$ g per cc. of the aqueous solution.

* * * * *